US011644766B2

(12) United States Patent
Okayasu

(10) Patent No.: US 11,644,766 B2
(45) Date of Patent: May 9, 2023

(54) IMAGE FORMING APPARATUS THAT CONTROLS VOLTAGES TO REDUCE IMAGE FOGGING

(71) Applicant: CANON KABUSHIKI KAISHA, Tokyo (JP)

(72) Inventor: Kohei Okayasu, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/332,473

(22) Filed: May 27, 2021

(65) Prior Publication Data

US 2021/0373453 A1 Dec. 2, 2021

(30) Foreign Application Priority Data

Jun. 1, 2020 (JP) ..... JP2020-095756

(51) Int. Cl.

| | |
|---|---|
| ***G03G 15/06*** | (2006.01) |
| ***G03G 15/16*** | (2006.01) |
| ***G03G 15/02*** | (2006.01) |
| ***G03G 15/00*** | (2006.01) |
| *G03G 13/24* | (2006.01) |

(52) U.S. Cl.

CPC ..... *G03G 15/065* (2013.01); *G03G 15/0266* (2013.01); *G03G 15/1675* (2013.01); *G03G 13/24* (2013.01); *G03G 15/5004* (2013.01)

(58) Field of Classification Search

CPC ... G03G 15/065; G03G 15/0266; G03G 15/16
See application file for complete search history.

(56) References Cited

U.S. PATENT DOCUMENTS 5,287,149 A * 2/1994 Hoshika ..... G03G 21/08 399/234
9,448,525 B2 9/2016 Tsutsumi
9,482,995 B2 * 11/2016 Hayakawa ..... G03G 15/065

FOREIGN PATENT DOCUMENTS

JP 2003066697 A * 3/2003
JP 2009-181073 A 8/2009
JP 2010-204322 A 9/2010
JP 2014-044332 A 3/2014
JP 2016-024399 A 2/2016

OTHER PUBLICATIONS

English translation of JP-2003066697-A (Year: 2003).*

* cited by examiner

*Primary Examiner* — Arlene Heredia
(74) *Attorney, Agent, or Firm* — Venable LLP

(57) ABSTRACT

A region of an image bearing member that comes into contact with a recording material at a nip in a state in which the recording material is held by the nip is a first region, and a region of the image bearing member that does not come into contact with the recording material at the nip in a state in which the recording material is not held by the nip is a second region. A controller controls to apply a first developing voltage to a developer bearing member when the first region in which a first surface potential has been formed faces a developer bearing member and apply a second developing voltage lower than an absolute value of the first developing voltage to the developer bearing member when the second region in which a second surface potential has been formed faces the developer bearing member.

19 Claims, 9 Drawing Sheets

IMAGE FORMING APPARATUS THAT CONTROLS VOLTAGES TO REDUCE IMAGE FOGGING

BACKGROUND OF THE INVENTION

Field of the Invention

The present invention relates to a printer such as a laser printer or an LED printer and an image forming apparatus such as a digital copier using an electrophotographic system or an electrostatic recording system, and a heating fixation apparatus.

Description of the Related Art

Image forming apparatuses use a direct transfer system that directly transfers a toner image on the surface of a photosensitive drum onto a recording paper at a transfer nip formed between the surface of the photosensitive drum and a transfer roller. Further, some image forming apparatuses of the direct transfer system do not have a static elimination light unit for the purpose of reducing cost. In this case, since a drum surface potential (the surface potential of a photosensitive drum) is not initialized by static elimination light before charging, a difference in a transfer discharging state at a transfer nip directly exerts an influence upon the drum surface potential in the image forming apparatuses of the direct transfer system. Accordingly, impedance changes depending on the presence or absence of a recording paper at the transfer nip, and a discharging state at the transfer nip becomes different. Therefore, a drum surface potential after the recording paper has passed through the transfer nip (during paper non-passing) is different from a drum surface potential at a time at which the recording paper is passing through the transfer nip (during paper passing). Specifically, discharging directly occurs between a transfer roller and the photosensitive drum without the interposition of a recording paper during the paper non-passing, and the uniformity of the drum surface potential is lost due to the influence of the cell or fuzz of the transfer roller. Therefore, the drum surface potential becomes disrupted.

When the disrupted drum surface potential after transfer does not become uniform at next charging, the record of the disrupted drum surface potential exerts an influence upon developing. As a result, an image failure called "memory" is possibly caused on an image of a subsequent recording paper. In order to solve the memory, it is necessary to adjust the drum surface potential for a next image forming step. Japanese Patent Application Laid-open No. 2010-204322 describes a technology relating to the memory. As a general adjustment method, a method in which a charging voltage is switched between the paper passing region (the region that a recording paper passing through a transfer nip comes into contact) and the paper non-passing region (the region that the recording paper does not come into contact) of a photosensitive drum has been known. A charging voltage V1 for forming a surface potential (Vd1) of the paper passing region and a charging voltage V2 for forming a surface potential (Vd2) of the paper non-passing region are set. Then, (the absolute value of) the surface potential (Vd2) of the paper non-passing region is made lower than (the absolute value of) the surface potential (Vd1) of the paper passing region in advance, and a charging voltage V1 is applied to a charging member at the timing of next print. In this manner, it is possible to solve the memory according to a discharging amount. In the case of jumping development, an extremely small amount of toner flies due to a potential difference between a surface potential of the photosensitive drum and a developing potential of a developing roller at the moment at which the developing voltage is applied to the developing roller. Therefore, a developing voltage is preferably not applied to the developing roller until the timing at which the paper passing region faces the developing roller in terms of a toner consumption amount. However, the developing potential is not stabilized immediately after the developing voltage is applied. Therefore, it is necessary to apply the developing voltage immediately before the paper passing region faces the developing roller in expectation of the time at which the developing potential is stabilized.

A potential difference (Vback) between the surface potential of the photosensitive drum and the developing potential of the developing roller exerts an influence upon a fogging amount on the photosensitive drum during image formation. Note that the attachment of unnecessary toner to the photosensitive drum is called fogging and an amount of the unnecessary toner on the photosensitive drum is called a fogging amount. FIG. 1 shows a general relationship between a potential difference (Vback) of monochrome toner and a fogging amount on a photosensitive drum. As shown in FIG. 1, the fogging amount on the photosensitive drum becomes large and toner having a normal charging polarity called ground fogging is developed on the photosensitive drum on a side where the potential difference (Vback) is small. Further, as shown in FIG. 1, the fogging amount on the photosensitive drum becomes large and toner having an inverted polarity (polarity opposite to the normal charging polarity) called reversal fogging is developed on the photosensitive drum on a side where the potential difference (Vback) is large.

The relationship between the potential difference (Vback) and the fogging amount changes depending on the characteristics of toner, and a potential difference called bottom at which the fogging amount is the smallest exists. The fogging amount of the paper passing region exerts a large influence upon a toner consumption amount, and the potential difference (Vback) is preferably set at the bottom in terms of the toner consumption amount. Note that in the present specification, the fact that potentials are large or small represents whether the potentials are large or small when their absolute values are compared with each other, and the fact that potentials are high or low represents whether the potentials are large or small when their absolute values are compared with each other.

FIG. 2 shows the output waveforms of respective potentials before and after the tip of the recording paper enters the transfer nip. As shown in FIG. 2, a potential difference (Vback2) between the surface potential (Vd2) and a developing potential of the paper non-passing region becomes smaller than that of the paper passing region when the surface potential (Vd2) of the paper non-passing region is made smaller than the surface potential (Vd1) of the paper passing region in order to solve the memory. Note that the output timings of the respective potentials in FIG. 2 are shown with their phases matching to a drum surface. In a charging member, a charging potential (Vpri1) for forming the surface potential (Vd1) of the paper passing region and a charging potential (Vpri2) for forming the surface potential (Vd2) of the paper non-passing region are formed.

It is shown by FIG. 2 that when a potential difference (Vback1) between the surface potential (Vd1) and a developing potential (Vdc) is set near the bottom, the potential difference (Vback2) between the surface potential (Vd2) and the developing potential (Vdc) decreases by an amount of

|Vd1−Vd2| and ground fogging occurs. The fogging of the paper non-passing region exerts an influence upon a toner consumption amount and causes stain on the transfer roller or the like. On the other hand, when the surface potential (Vd2) of the paper non-passing region is increased in order to increase the potential difference (Vback2) so that fogging does not occur in the paper non-passing region, it is necessary to further increase the charging potential (Vpri1) to solve the memory. When the charging potential (Vpri1) is further increased, the surface potential (Vd1) of the paper passing region further increases, which results in an increase in a discharging amount at a transfer portion and may adversely affect transfer. Further, since the surface potential (Vd1) of the paper passing region increases, the potential difference (Vback1) increases more than necessary. When the potential difference (Vback1) is too large, a desired toner putting amount is not obtained, reversal fogging is likely to occur on a photosensitive drum, and a toner consumption amount is worsened. The present invention has been made in order to solve the above problems and has an object of providing a technology to reduce memory occurring at a transfer nip and reduce fogging.

SUMMARY OF THE INVENTION

In order to achieve the object described above, an image forming apparatus according to the present invention includes: an image bearing member that is rotatable; a charging member that charges a surface of the image bearing member at a charging portion; an exposure portion that exposes the image bearing member to form an electrostatic latent image on the surface of the image bearing member; a developer bearing member that bears a developer charged to have a normal polarity and supplies the developer to the electrostatic latent image formed on the surface of the image bearing member to form a developer image on the surface of the image bearing member; a transfer member that comes into contact with the image bearing member to form a nip and transfers the developer image onto a recording material conveyed to the nip; a charging voltage application portion that applies a charging voltage to the charging member; a developing voltage application portion that applies a developing voltage to the developer bearing member; a transfer voltage application portion that applies a transfer voltage to the transfer member; and a controller that controls the charging voltage application portion, the developing voltage application portion, and the transfer voltage application portion, wherein, when a region of the image bearing member that comes into contact with the recording material at the nip in a state in which the transfer voltage is applied to the transfer member and the recording material is held by the nip is assumed as a first region and a region of the image bearing member that does not come into contact with the recording material at the nip in a state in which the transfer voltage is applied to the transfer member and the recording material is not held by the nip is assumed as a second region, the controller controls to apply a first developing voltage to the developer bearing member when the first region in which a first surface potential has been formed at the charging portion faces the developer bearing member and apply a second developing voltage smaller than an absolute value of the first developing voltage to the developer bearing member when the second region in which a second surface potential has been formed at the charging portion faces the developer bearing member after the recording material passes through the nip.

In order to achieve the object described above, an image forming apparatus according to the present invention includes: an image bearing member that is rotatable; a charging member that charges a surface of the image bearing member at a charging portion; an exposure portion that exposes the image bearing member to form an electrostatic latent image on the surface of the image bearing member; a developer bearing member that bears a developer charged to have a normal polarity and supplies the developer to the electrostatic latent image formed on the surface of the image bearing member to form a developer image on the surface of the image bearing member; a transfer member that comes into contact with the image bearing member to form a nip and transfers the developer image onto a recording material conveyed to the nip; a charging voltage application portion that applies a charging voltage to the charging member; a developing voltage application portion that applies a developing voltage to the developer bearing member; a transfer voltage application portion that applies a transfer voltage to the transfer member; and a controller that controls the charging voltage application portion, the developing voltage application portion, and the transfer voltage application portion, wherein, when a region of the image bearing member that comes into contact with the recording material at the nip in a state in which the transfer voltage is applied to the transfer member and the recording material is held by the nip is assumed as a first region, a region of the image bearing member that does not come into contact with the recording material at the nip in a state in which the transfer voltage is applied to the transfer member and the recording material is not held by the nip is assumed as a second region, and a region of the image bearing member that is positioned between the first region and the second region and comes into contact with the recording material at the nip in a state in which the transfer voltage is applied to the transfer member and the recording material is held by the nip is assumed as a third region, the controller controls to apply a first developing voltage to the developer bearing member when the first region in which a first surface potential has been formed at the charging portion faces the developer bearing member and apply a second developing voltage smaller than an absolute value of the first developing voltage to the developer bearing member when the second region in which a second surface potential has been formed at the charging portion faces the developer bearing member after the recording material passes through the nip, a developing potential formed in the developer bearing member overshoots when the third region in which a third surface potential has been formed at the charging portion faces the developer bearing member and when the second developing voltage is switched to the first developing voltage, and an absolute value of the developing potential due to an overshoot of the developing potential is larger than an absolute value of the developing potential formed when the first developing voltage is applied to the developer bearing member.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the drawings. However, the dimensions, materials, shapes, relative arrangements, or the like of constituting components described in the embodiments should be appropriately changed according to the configurations, various conditions, or the like of an apparatus to which the invention is applied, and are not intended to limit the scope of the invention to the following embodiments.

First Embodiment

Image Forming Apparatus

Figure 1:
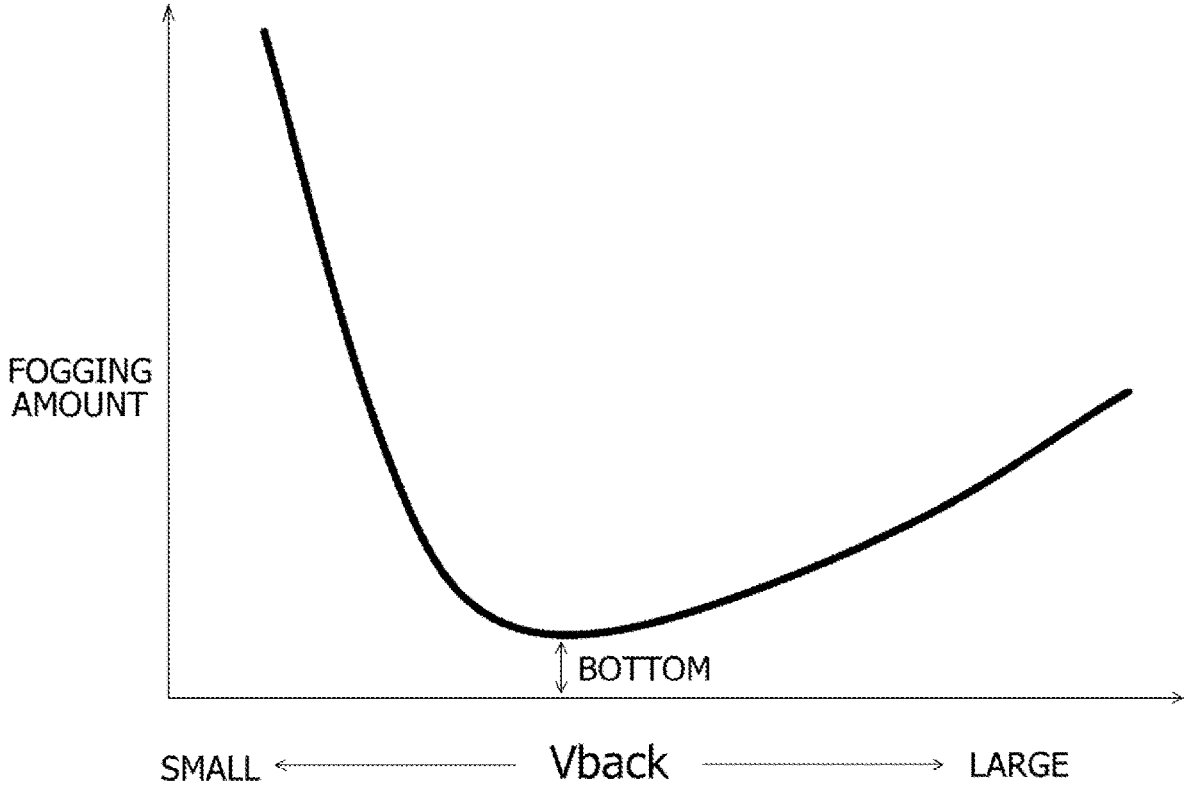
FIG. 1 is a diagram showing a fogging amount of monochrome toner.
Figure 2:
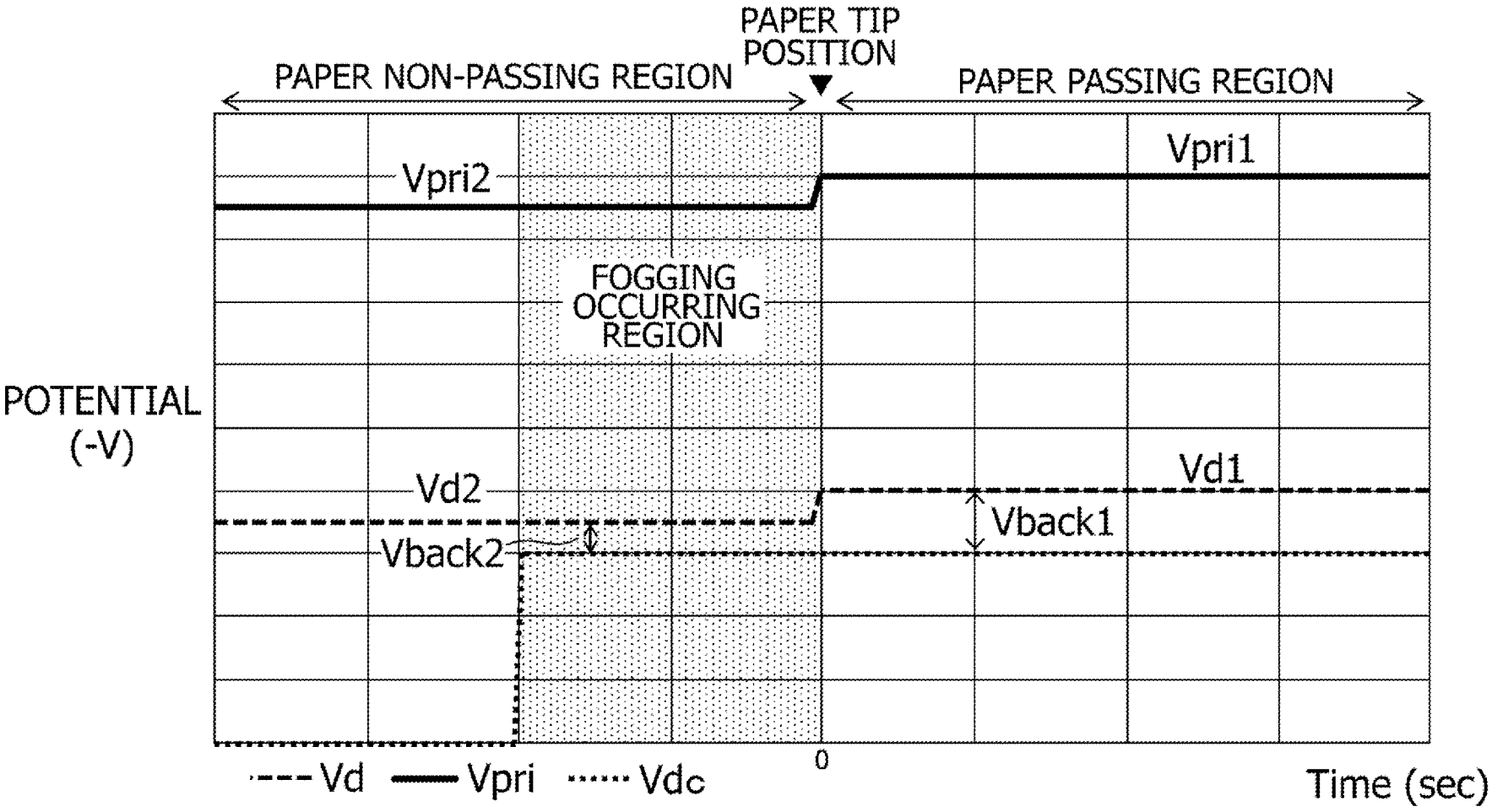
FIG. 2 is a diagram showing the output waveforms of respective potentials.
Figure 3:
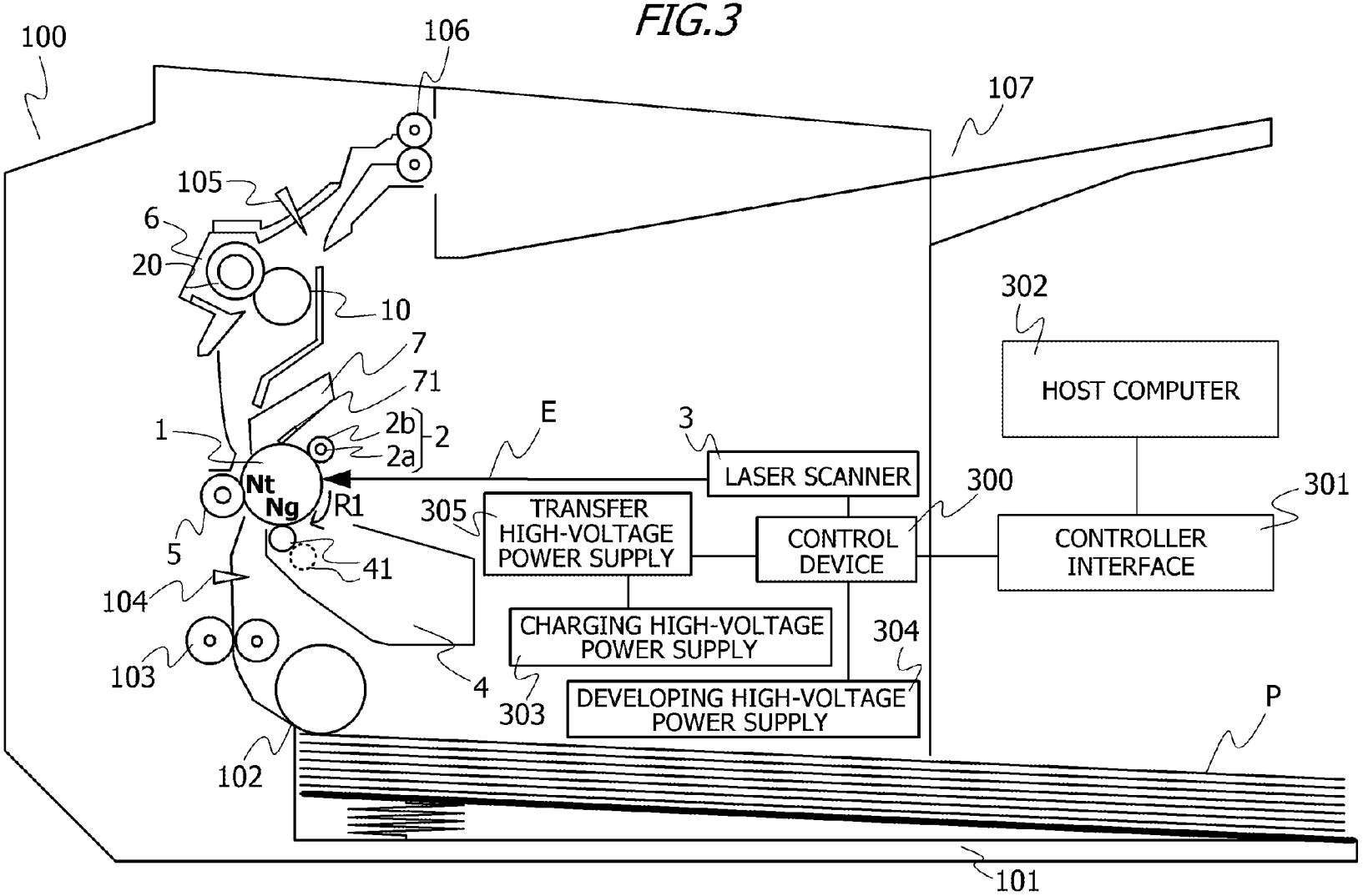
FIG. 3 is a diagram of the configuration of an image forming apparatus according to a first embodiment.

FIG. 3 shows an image forming apparatus 100 according to a first embodiment, that is, the image forming apparatus 100 including a heating fixation apparatus and a printer control device according to the first embodiment. Note that FIG. 3 is a vertical cross-sectional view showing the schematic configuration of a laser printer as an example of the image forming apparatus 100 according to the first embodiment. First, the configuration of the image forming apparatus 100 will be described in detail with reference to FIG. 3. The image forming apparatus 100 is, for example, a printer such as a laser printer or an LED printer, or an image forming apparatus such as a digital copier using an electrophotographic system or an electrostatic recording system.

The image forming apparatus 100 includes a drum-type electrophotographic photosensitive member (hereinafter described as a "photosensitive drum") 1 serving as an image bearing member and a charging roller (charging member) 2 that charges the surface of the photosensitive drum 1. The photosensitive drum 1 is one obtained by providing a photosensitive material such as an OPC (organic photoconductor), amorphous selenium, and amorphous silicon on a drum substrate on a cylinder formed of an aluminum alloy, nickel, or the like. The photosensitive drum 1 that is rotatable is rotated and driven at a prescribed process speed (peripheral speed) in an arrow R1 direction by a driving means (not shown). A charging portion on the surface of the photosensitive drum 1 is uniformly charged to have a prescribed polarity and potential by the charging roller 2. Thus, a dark part potential VD is formed in the photosensitive drum 1.

The charging roller 2 of the first embodiment is a contact charging roller and constituted by an electric conductor roller 2*a* such as a metal roller serving as a cored bar and a cylindrical conductive layer 2*b* formed on the outer peripheral surface of the electric conductor roller 2*a*. The charging roller 2 is arranged parallel to the photosensitive drum 1 with both ends of the electric conductor roller 2*a* journaled in bearing members (not shown). Further, the charging roller 2 is brought into pressure contact with the photosensitive drum 1 by pressing means such as a spring (not shown) and rotates with the rotation of the photosensitive drum 1. The image forming apparatus 100 has a charging high-voltage power supply (charging voltage application portion) 303 that applies a charging voltage to the charging roller 2.

The surface of the photosensitive drum 1 after charging is exposed by a laser beam E for image formation from a laser scanner (exposure portion) 3, and an electrostatic latent image is formed on the surface of the photosensitive drum 1. The laser scanner 3 performs scanning exposure subjected to ON/OFF control according to image information in the longitudinal direction of the photosensitive drum 1 and eliminates charges from an exposure region to form an electrostatic latent image on the surface of the photosensitive drum 1. That is, the photosensitive drum 1 after charging is exposed, and a light portion potential VL is formed in the photosensitive drum 1. An electrostatic latent image formed by a dark part potential VD and a light portion potential VL of the photosensitive drum 1 is developed and visualized at a developing portion Ng formed by a developing apparatus (developing means) 4 and the photosensitive drum 1. In the present embodiment, a jumping development method by which a gap is provided between the developing apparatus 4 and the photosensitive drum 1 is used. Besides the jumping development method, a two-component developing method, a contact developing method, or the like is used as a development method. Image exposure and reversal development may be combined together. When toner (developer) borne by a developing roller (developer bearing member) 41 is attached to the photosensitive drum 1 at the developing portion Ng, an electrostatic latent image described above is developed as a toner image (developer image). As described above, the developing roller 41 bears toner charged to have a normal polarity and supplies the toner to an electrostatic latent image formed on the surface of the photosensitive drum 1 to form a toner image on the surface of the photosensitive drum 1. In the present embodiment, the normal polarity of the toner is a negative polarity. Note that the normal polarity of the toner may be a positive polarity. In this case, the polarity of a voltage applied to respective members is only required to be opposite to the polarity of the present embodiment. The image forming apparatus 100 has a developing high-voltage power supply (developing voltage application portion) 304 that applies a developing voltage to the developing roller 41.

Recording papers (recording materials) P are accommodated in a paper feeding tray 101. The image forming apparatus 100 includes a transfer roller (transfer member) 5. The transfer roller 5 comes into contact with the photosensitive drum 1 to form a transfer nip portion (nip) Nt. Each of the recording papers P accommodated in the paper feeding tray 101 is individually fed by a paper feeding roller 102 and conveyed to the transfer nip portion Nt between the photosensitive drum 1 and the transfer roller 5 via conveyance rollers 103 or the like. At this time, the tip-end position of the recording paper P is detected by a top sensor 104. The timing at which the tip end of the recording paper P reaches the transfer nip portion Nt is detected on the basis of a distance between the detecting position of the top sensor 104 and the position of the transfer nip portion Nt and the conveyance speed of the recording paper P. Further, the rear-end position of the recording paper P is detected by the top sensor 104. The timing at which the rear end of the recording paper P reaches the transfer nip portion Nt is detected on the basis of a distance between the detecting position of the top sensor 104 and the position of the transfer nip portion Nt and the conveyance speed of the recording paper P. The image forming apparatus 100 has a transfer high-voltage power supply (transfer voltage application unit) 305 that applies a transfer voltage to the transfer roller 5. When a transfer voltage is applied to the transfer roller 5, a toner image on the photosensitive drum 1 is transferred onto the recording paper P that is fed and conveyed at prescribed timing in the manner described above.

The recording paper P onto which a toner image has been transferred is conveyed to the heating fixation apparatus (fixation means) 6. When the recording paper P is heated and pressed while being held and conveyed by a fixation nip portion between a heating member 10 and a pressure roller 20 in the heating fixation apparatus 6, the toner image is fixed onto the surface of the recording paper P. Then, the recording paper P is discharged by paper discharging rollers 106 onto a paper discharging tray 107 formed on the upper surface of the image forming apparatus 100. Note that the presence or absence of the occurrence of a jam or the like is monitored during this time in such a manner that a paper discharging sensor 105 detects the timing at which the tip end and the rear end of the recording paper P pass therethrough. On the other hand, in the photosensitive drum 1 from which the toner image has been transferred, toner (untransferred toner) that has remained on the surface without being transferred onto the recording paper P is removed by a cleaning blade 71 of a cleaning apparatus (cleaning means) 7 and subjected to next image formation. By repeatedly performing the above operations, the image forming apparatus 100 is capable of performing image formation one after another. Note that the image forming apparatus 100 of the first embodiment is an example of an apparatus that has a resolution of 600 dpi, outputs 30 prints per minute (LTR longitudinal feed: a process speed of about 222 mm/s), and comes to the end of its life after outputting 100,000 prints.

Printer Control Apparatus

A control device (printer control device) 300 serving as a controller connects to a host computer 302 using a controller interface 301 to perform communication with the host computer 302. The control device 300 controls a charging voltage applied to the charging roller 2 according to a detection result (detection information) of the top sensor 104. By controlling the charging high-voltage power supply 303, the control device 300 performs control to switch between a first charging voltage for forming a charging potential (Vpri1) in the charging roller 2 and a second charging voltage for forming a charging potential (Vpri2) in the charging roller 2. The charging potential (Vpri1) is an example of a first charging potential, and the charging potential (Vpri2) is an example of a second charging potential. The absolute value of the charging potential (Vpri1) is larger than that of the charging potential (Vpri2). The first charging voltage and the second charging voltage have the same polarity, and the absolute value of the first charging voltage is larger than that of the second charging voltage. The first embodiment describes a case in which a charging potential and a charging voltage have a negative polarity, but it is assumed that the charging potential and the charging voltage have a positive polarity when the normal polarity of toner is a positive polarity as described above. Further, by controlling the transfer high-voltage power supply 305, the control device 300 controls a transfer voltage applied to the transfer roller 5.

In the first embodiment, a state in which the recording paper P exists at the transfer nip portion Nt will be called a paper passing state. The surface region of the photosensitive drum 1 has at least a first region and a second region. The first region of the surface region of the photosensitive drum 1 comes into contact with the recording paper P at the transfer nip portion Nt. In the first embodiment, the first region of the photosensitive drum 1 will be called a paper passing region. The paper passing region is the region of the photosensitive drum 1 that comes into contact with the recording paper P at the transfer nip portion Nt in a state in which a transfer voltage is applied to the transfer roller 5 and the recording paper P is held by the transfer nip portion Nt. A paper non-passing region is the region of the photosensitive drum 1 that does not come into contact with the recording paper P at the transfer nip portion Nt in a state in which a transfer voltage is applied to the transfer roller 5 and the recording paper P is not held by the transfer nip portion Nt. In the first embodiment, a state in which the recording paper P before reaching the transfer nip portion Nt does not exist at the transfer nip portion Nt will be called a paper non-passing state. The second region of the surface region of the photosensitive drum 1 does not come into contact with the recording paper P at the transfer nip portion Nt. In the first embodiment, the second region of the photosensitive drum 1 will be called a paper non-passing region. The paper non-passing region is positioned downstream of the paper passing region in the rotating direction of the photosensitive drum 1. When a first charging voltage is applied to the charging roller 2 and the paper passing region is charged by the charging roller 2, a surface potential (first surface potential) is formed in the paper passing region. When a second charging voltage is applied to the charging roller 2 and the paper non-passing region is charged by the charging roller 2, a surface potential (second surface potential) is formed in the paper non-passing region. The paper non-passing region is positioned downstream of the paper passing region in the rotating direction of the photosensitive drum 1. Therefore, the surface potential is formed in the paper passing region after the surface potential is formed in the paper non-passing region.

The control device 300 acquires information on the timing at which the paper passing region faces the developing roller 41 on the basis of a detection result of the top sensor 104, a distance between the position of the transfer nip portion Nt and the position of the developing roller 41, and the rotation speed of the photosensitive drum 1. As the position of the developing roller 41, the position on the surface of the developing roller 41 that is the closest to the photosensitive drum 1 may be used. The control device 300 may determine that the paper passing region faces the developing roller 41 when a distance between the paper passing region and the surface of the developing roller 41 is not more than a prescribed distance. Hereinafter, information on the timing at which the paper passing region faces the developing roller 41 will be expressed as information on first timing.

The control device 300 acquires information on the timing at which the paper non-passing region faces the developing roller 41 on the basis of a detection result of the top sensor 104, a distance between the position of the transfer nip portion Nt and the position of the developing roller 41, and the rotation speed of the photosensitive drum 1. The control device 300 may determine that the paper non-passing region faces the developing roller 41 when a distance between the paper non-passing region and the surface of the developing roller 41 is not more than a prescribed distance. Hereinafter, information on the timing at which the paper non-passing region faces the developing roller 41 will be expressed as information on second timing.

The control device 300 acquires the surface potential (first surface potential) of the paper passing region and the surface potential (second surface potential) of the paper non-passing region. The control device 300 may calculate the surface potential of the paper passing region and the surface potential of the paper non-passing region on the basis of a charging voltage applied to the charging roller 2. The control device 300 may correct the calculated surface potential of the paper passing region and the surface potential of the paper non-passing region according to the ambient (external environment) temperature and humidity of the image forming apparatus 100. The control device 300 may measure the surface potential of the paper passing region and the surface potential of the paper non-passing region. The control device 300 controls a developing voltage applied to the developing roller 41 on the basis of the surface potential of the paper passing region, the surface potential of the paper non-passing region, information on the first timing, and information on the second timing. By controlling the developing high-voltage power supply 304, the control device 300 performs control to switch between a first developing voltage for forming a developing potential (Vdc1) in the developing roller 41 and a second developing voltage for forming a developing potential (Vdc2) in the developing roller 41. The developing potential (Vdc1) is an example of a first developing potential, and the developing potential (Vdc2) is an example of a second developing potential.

The control device 300 controls the developing high-voltage power supply 304 on the basis of information on the first timing so that a first developing voltage is applied to the developing roller 41 when the paper passing region in which a surface potential has been formed faces the developing roller 41. When the paper passing region in which the surface potential has been formed faces the developing roller 41, the developing high-voltage power supply 304 applies a first developing voltage to the developing roller 41. The control device 300 controls the developing high-voltage power supply 304 so that a first developing voltage is applied to the developing roller 41 when the paper passing region in which a first surface potential has been formed faces the developing roller 41 in the charging portion on the surface of the photosensitive drum 1 after the recording paper has passed through the transfer nip portion Nt. Thus, a developing potential (Vdc1) is formed in the developing roller 41 when the paper passing region in which a surface potential has been formed faces the developing roller 41. The control device 300 controls the developing high-voltage power supply 304 on the basis of information on the second timing so that a second developing voltage is applied to the developing roller 41 when the paper non-passing region in which a surface potential has been formed faces the developing roller 41. When the paper non-passing region in which the surface potential has been formed faces the developing roller 41, the developing high-voltage power supply 304 applies a second developing voltage to the developing roller 41. The control device 300 performs control to apply the second developing voltage smaller than the absolute value of the first developing voltage to the developing roller 41 when the paper non-passing region in which a second surface potential has been formed in the charging portion on the surface of the photosensitive drum 1 faces the developing roller 41. Thus, a developing potential (Vdc2) has been formed in the developing roller 41 when the paper non-passing region in which a surface potential has been formed faces the developing roller 41. Since the paper non-passing region is positioned downstream of the paper passing region in the rotating direction of the photosensitive drum 1, the developing potential (Vdc1) is formed in the developing roller 41 after the developing potential (Vdc2) is formed in the developing roller 41. The control device 300 determines the value of the first developing voltage on the basis of the surface potential of the paper passing region, and determines the value of the second developing voltage on the basis of the surface potential of the paper non-passing region. The details of the value of the first developing voltage and the value of the second developing voltage will be described later.

The relationship between the potentials of the respective members in the first embodiment will be described using FIG. 4.

Charging Potential

Charging Potential to Paper Passing Region

As a first charging voltage, a DC voltage of −900 V is applied to the charging roller 2 from the charging high-voltage power supply 303. Thus, for example, under an environment at a temperature of 25° C. and a relative humidity of 60%, the paper passing region is charged at a surface potential Vd1 of −400 V. As shown in FIG. 4, a charging potential (Vpri1) of −900 V is formed in the charging roller 2 when a first charging voltage is applied to the charging roller 2, and a surface potential (Vd1) of −400 V is formed in the paper passing region.

After the surface of the photosensitive drum 1 is charged by the charging roller 2, the charging surface of the photosensitive drum 1 moves to the laser irradiation position of the laser scanner 3, and the charging surface of the photosensitive drum 1 is exposed by the laser beam E for image formation. Thus, a light portion potential VL (image portion potential) developed by toner in a subsequent developing step is formed in the photosensitive drum 1. The light portion potential VL is −100 V.

Charging Potential to Paper Non-Passing Region

As a second charging voltage, a DC voltage of −850 V is applied to the charging roller 2 from the charging high-voltage power supply 303. Thus, for example, under an environment at a temperature of 25° C. and a relative humidity of 60%, the surface of the photosensitive drum 1 is charged at a surface potential Vd2 of −350 V. As shown in FIG. 4, a charging potential (Vpri2) of −850 V is formed in the charging roller 2 when a second charging voltage is applied to the charging roller 2, and a surface potential (Vd2) of −350 V is formed in the paper non-passing region. The absolute value of the surface potential (Vd1) of the paper passing region is larger than that of the surface potential (Vd2) of the paper non-passing region.

Developing Voltage

An AC voltage is applied to the developing roller 41 as a developing voltage. For example, when the developing roller 41 is arranged in a non-contact state with respect to the photosensitive drum 1 (jumping development method) like the configuration of the present embodiment, an AC voltage is applied to the developing roller 41. In the first embodiment, an AC voltage having a duty of 50%, a frequency of 3 kHz, and a peak-to-peak voltage of 1750 V is applied from the developing high-voltage power supply 304 to the developing roller 41. The AC voltage in the first embodiment is an actual value. By controlling the duty ratio and/or the peak-to-peak voltage of the AC voltage, the control device 300 controls a developing voltage applied to the developing roller 41. Further, by superimposing a DC voltage on the AC voltage, the control device 300 may control the developing voltage applied to the developing roller 41.

Developing Potential to Paper Passing Region

Figure 4:
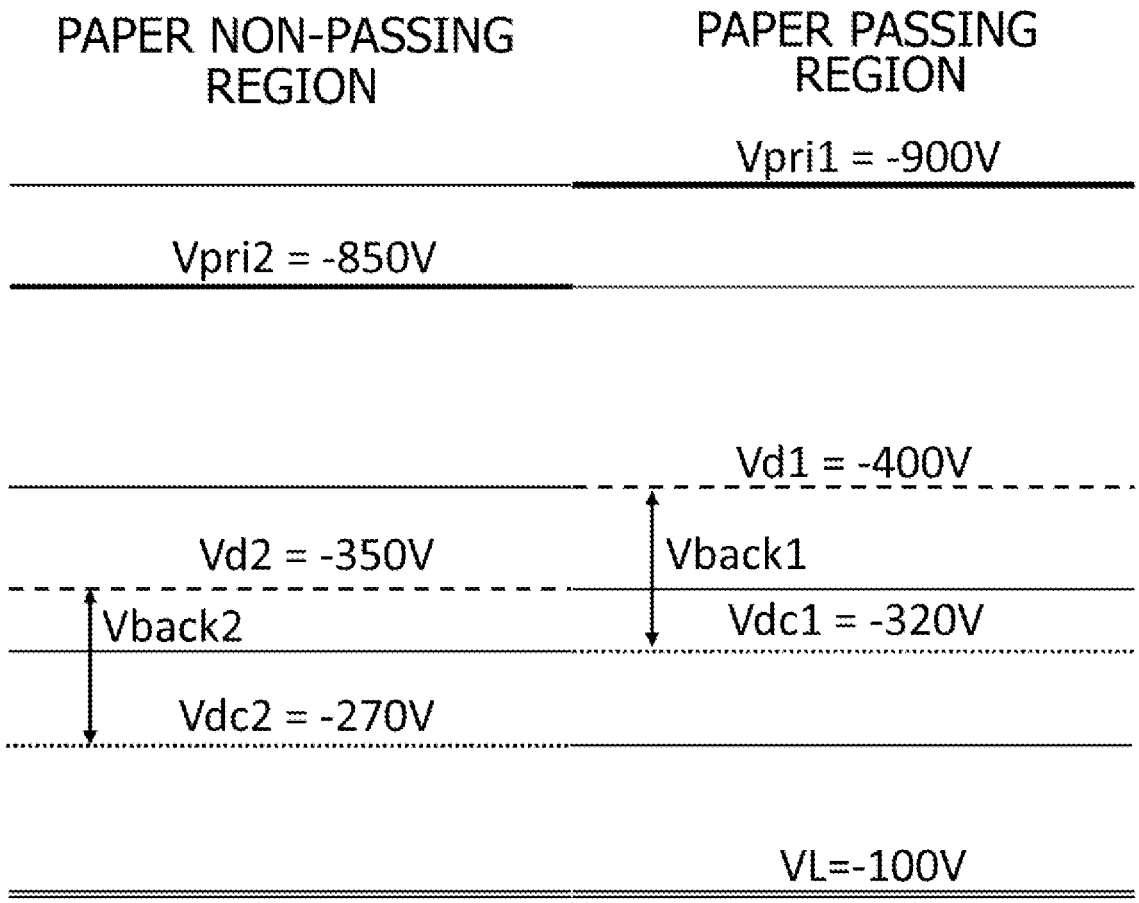
FIG. 4 is a diagram showing the relationship between the respective potentials according to the first embodiment.

As shown in FIG. 4, a developing potential (Vdc1) of −320 V is formed in the developing roller 41 when a developing voltage (first developing voltage) of −320 V is applied to the developing roller 41. Thus, the developing potential (Vdc1) of −320 V is formed in the developing roller 41 when the paper passing region faces the developing roller 41.

Developing Potential to Paper Non-Passing Region

As shown in FIG. 4, a developing potential (Vdc2) of −270 V is formed in the developing roller 41 when a developing voltage (second developing voltage) of −270 V is applied to the developing roller 41. Thus, the developing potential (Vdc2) of −270 V is formed in the developing roller 41 when the paper non-passing region faces the developing roller 41.

The absolute value of the first developing voltage is larger than that of the second developing voltage. The control device 300 controls the developing high-voltage power supply 304 so that the absolute value of the first developing voltage becomes larger than that of the second developing voltage. The absolute value of the developing potential (Vdc1) is larger than that of the developing potential (Vdc2). The surface potentials (Vd1 and Vd2), the charging potentials (Vpri1 and Vpri2), and the developing potentials (Vdc1 and Vdc2) have the same polarity. The first and second charging voltages and the first and second developing voltages have the same polarity. The polarity of each of the surface potentials (Vd1 and Vd2) and the first and second developing voltages may be a normal polarity. In addition, the polarity of each of respective potentials and respective voltages may be a normal polarity.

Figure 5:
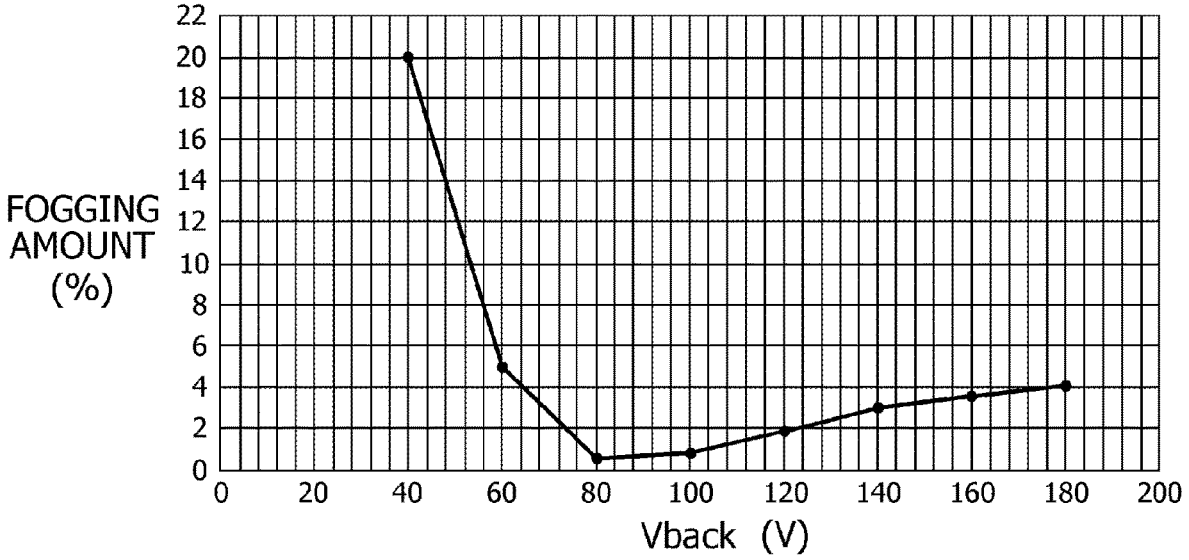
FIG. 5 is a diagram showing a fogging amount of toner according to the first embodiment.

FIG. 5 is a graph showing the relationship between a potential difference (Vback) between a surface potential (Vd) of the photosensitive drum 1 and a developing potential (Vdc) of the developing roller 41 and a fogging amount on the photosensitive drum 1. In FIG. 5, a vertical axis shows the fogging amount on the photosensitive drum 1, and a horizontal axis shows the potential difference (Vback) between the surface potential (Vd) of the photosensitive drum 1 and the developing potential (Vdc) of the developing roller 41. Here, a method for measuring the fogging amount on the photosensitive drum 1 will be described. The following measurement method is only an example, and the fogging amount on the photosensitive drum 1 may be measured by another measurement method. First, the surface of the photosensitive drum 1 is taped up by a polyester adhesive tape, and fogging toner on the surface of the photosensitive drum 1 is peeled off by the adhesive tape. The peeled-off adhesive tape is affixed to a white plate, and the whiteness degree of the white plate to which the adhesive tape has been affixed is measured by a white photometer TS-6DS/A (manufactured by Tokyo Denshoku Co. Ltd.). Meanwhile, an adhesive tape is directly affixed to the white plate, and the whiteness degree of the white plate to which the adhesive tape has been affixed is also measured. The whiteness degree (first whiteness degree) of the adhesive tape (first adhesive tape) that has been affixed to the white plate after taping up the surface of the photosensitive drum 1 and the whiteness degree (second whiteness degree) of the adhesive tape (second adhesive tape) that has been directly affixed to the white plate are compared with each other. When the area of the first adhesive tape and the area of the second adhesive tape are the same, it is possible to calculate the first whiteness degree (%) by (the area of the first adhesive tape— the area of the toner in the first adhesive tape)/the area of the first adhesive tape. In this case, the second whiteness degree (%) is 100%. A difference between the first whiteness degree (%) and the second whiteness degree (%) is assumed as a fogging amount. Further, the fogging amount may be the ratio of the area of the toner in the first adhesive tape to the area of the first adhesive tape. As described above, the fogging amount on the photosensitive drum 1 may be the ratio of the area of toner in a prescribed region out of the surface region of the photosensitive drum 1 to the area of the prescribed region out of the surface region of the photosensitive drum 1.

It is shown by FIG. 5 that fogging is most favorable at about a potential difference (Vback) of 80 V in the first embodiment and becomes worse at a potential difference (Vback) of 80 V or smaller or 80 V or larger. The fogging has a range in which the quality of an image is allowable. In the first embodiment, a case in which the fogging amount is 3% is assumed as a limitation point at which the quality of an image is allowable. The fogging amount is measured in the manner described above. In the first embodiment, there is no problem in the quality of an image when the fogging amount is not more than 2%. When the potential difference (Vback) is at least 75 V and not more than 120 V, it is possible to obtain an image with favorable quality.

During image formation (paper passing state), respective potentials may be preferably set so that a potential difference (Vback1=|Vd1−Vdc1|) between a surface potential (Vd1) and a developing potential (Vdc1) of the paper passing region becomes at least 75 V and not more than 120 V. In the first embodiment, respective potentials are set so that a potential difference (Vback1) serving as a first potential difference becomes 80 V. For example, when the surface potential (Vd1) of the paper passing region is −400 V during image formation, the developing potential (Vdc1) is set at −320 V. Thus, it is possible to reduce the fogging of the paper passing region during image formation. Further, during non-image formation (paper non-passing state), respective potentials may be preferably set so that a potential difference (Vback2=|Vd2−Vdc2|) between a surface potential (Vd2) and a developing potential (Vdc2) of the paper non-passing region becomes at least 75 V and not more than 120 V. In the first embodiment, respective potentials are set so that a potential difference (Vback2) serving as a second potential difference becomes 80 V. For example, when the surface potential (Vd2) of the paper non-passing region is −350 V during non-image formation, the developing potential (Vdc2) is set at −270 V. Thus, it is possible to reduce the fogging of the paper passing region during image formation.

The control device 300 may control the charging high-voltage power supply 303 and the developing high-voltage power supply 304 so that a potential difference (Vback1), at which the ratio of the area of toner in the paper passing region to the area of the paper passing region becomes not more than 2%, is formed. The control device 300 may control the charging high-voltage power supply 303 and the developing high-voltage power supply 304 so that a potential difference (Vback1), at which the ratio of the area of toner in the paper passing region to the area of the paper passing region falls within a range in which the quality of an image is allowable, is formed. The control device 300 may control the charging high-voltage power supply 303 and the developing high-voltage power supply 304 so that a potential difference (Vback2), at which the ratio of the area of toner in the paper non-passing region to the area of the paper non-passing region becomes not more than 2%, is formed. The control device 300 may control the charging high-voltage power supply 303 and the developing high-voltage power supply 304 so that a potential difference (Vback2), at which the ratio of the area of toner in the paper non-passing region to the area of the paper non-passing region falls within a range in which the quality of an image is allowable, is formed.

Figure 6:
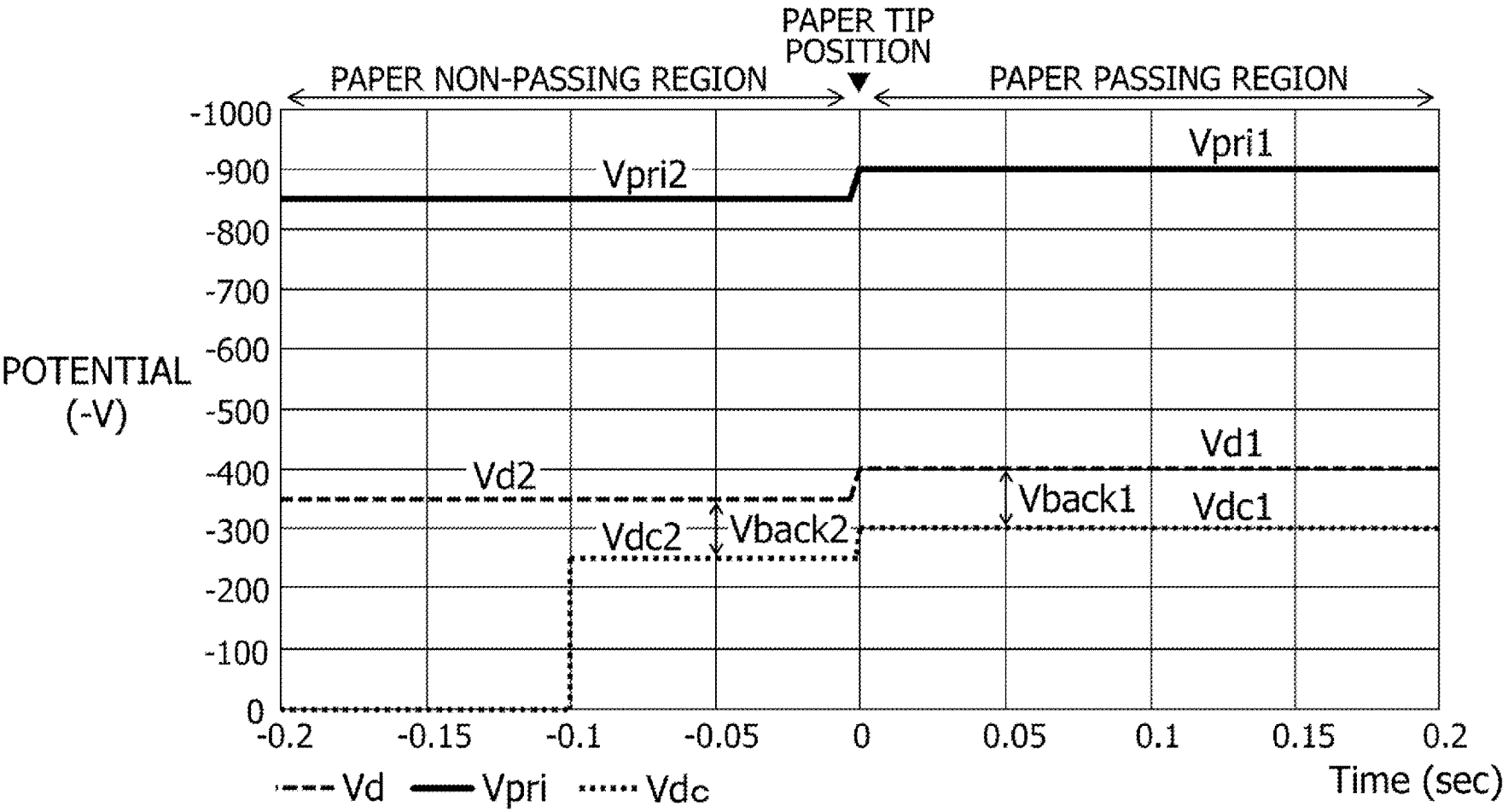
FIG. 6 is a diagram showing the output waveforms of the respective potentials according to the first embodiment.

FIG. 6 shows the waveforms of respective potentials in the first embodiment. In FIG. 6, a Y-axis (vertical axis) shows a potential. In FIG. 6, the waveforms of the respective potentials before and after the tip end of the recording paper P enters the transfer nip portion Nt are shown. The timings at which the respective potentials are output are shown with their phases matching to the surface of the photosensitive drum 1. A coordinate 0 in an X-axis shows the timing at which the tip end of the recording paper P enters the transfer nip portion Nt. A charging potential (Vpri2) is formed in the charging roller 2 when a second charging voltage is applied to the charging roller 2, and a surface potential (Vd2) is formed in the paper non-passing region. The second charging voltage is applied to the charging roller 2 so that the surface potential (Vd2) is formed in the paper non-passing region. That is, the second charging voltage is applied to the charging roller 2 so that the surface potential (Vd2) is formed in the surface region (paper non-passing region) of the photosensitive drum 1 at the transfer nip portion Nt when the recording paper P does not exist at the transfer nip portion Nt.

A developing voltage is turned on 100 milliseconds before the recording paper P enters the transfer nip portion Nt. At this time, a developing potential (Vdc2) is formed in the developing roller 41 when a second developing voltage is applied to the developing roller 41. Accordingly, a potential difference (Vback2=|Vd2−Vdc2|) between the surface potential (Vd2) of the paper non-passing region when the paper non-passing region faces the developing roller 41 and the developing potential (Vdc2) when the paper non-passing region faces the developing roller 41 becomes 80 V. Thus, the fogging of the paper non-passing region is reduced. Note that time in the X-axis (horizontal axis) of FIG. 6 shows the timing at which the second developing voltage is applied to the developing roller 41 and does not show the timing at which the second developing voltage is switched to the first developing voltage. Further, the timing at which the second developing voltage is applied to the developing roller 41 is not limited to the timing 100 milliseconds before the recording paper P enters the transfer nip portion Nt but may be another timing. The second developing voltage may be applied to the developing roller 41 a prescribed time (for example, 100 milliseconds) after the timing at which the tip end of the paper non-passing region (the rear end of the paper passing region) on a downstream side in the rotating direction of the photosensitive drum 1 reaches a position facing the developing roller 41.

The second charging voltage is switched to the first charging voltage so that a surface potential (Vd1) is formed in the paper passing region, and the first charging voltage is applied to the charging roller 2. That is, the first charging voltage is applied to the charging roller 2 so that the surface potential (Vd1) is formed in the surface region (paper passing region) of the photosensitive drum 1 at the transfer nip portion Nt when the recording paper P exists at the transfer nip portion Nt. The first charging voltage is applied to the charging roller 2, a charging potential (Vpri1) is formed in the charging roller 2, and the surface potential (Vd1) is formed in the paper passing region. Like this, the surface potential (Vd2) is switched to the surface potential (Vd1) according to the timing (X coordinate: 0) at which the charging potential (Vpri2) is switched to the charging potential (Vpri1) and the recording paper P enters the transfer nip portion Nt.

The control device 300 switches the second developing voltage to the first developing voltage at the timing at which the tip end of the paper passing region on the downstream side in the rotating direction of the photosensitive drum 1 reaches the position facing the developing roller 41. Accordingly, a potential difference (Vback1=|Vd1−Vdc1|) between the surface potential (Vd1) of the paper passing region when the paper passing region faces the developing roller 41 and the developing potential (Vdc1) when the paper passing region faces the developing roller 41 becomes 80 V. Thus, the fogging of the paper passing region is reduced. The timing at which the second developing voltage is switched to the first developing voltage is not limited to the timing at which the tip end of the paper passing region reaches the position facing the developing roller 41. The control device 300 may switch the second developing voltage to the first developing voltage before the timing at which the tip end of the paper passing region reaches the position facing the developing roller 41. For example, the control device 300 may switch the second developing voltage to the first developing voltage 10 milliseconds before the timing at which the tip end of the paper passing region reaches the position facing the developing roller 41.

Confirmation of Effect

The image forming apparatus 100 of the first embodiment switches between a first charging voltage for forming the surface potential (Vd1) of the paper passing region and a second charging voltage for forming the surface potential (Vd2) of the paper non-passing region. Further, the image forming apparatus 100 applies a second developing voltage to the developing roller 41 when the paper non-passing region faces the developing roller 41. That is, the image forming apparatus 100 applies the second developing voltage to the developing roller 41 at prescribed timing after the surface potential (Vd2) is formed in the paper non-passing region. Then, the image forming apparatus 100 applies a first developing voltage to the developing roller 41 when the paper passing region faces the developing roller 41. That is, the image forming apparatus 100 applies the first developing voltage to the developing roller 41 at prescribed timing after the surface potential (Vd2) is formed in the paper non-passing region. A developing potential (Vdc1) is formed in the developing roller 41 when the first developing voltage is applied to the developing roller 41. Between the developing potential (Vdc1) and the surface potential (Vd1) of the paper passing region, a prescribed potential difference (Vback1) is secured. The developing potential (Vdc2) is formed in the developing roller 41 when the second developing voltage is applied to the developing roller 41. Between the developing potential (Vdc2) and the surface potential (Vd2) of the paper non-passing region, a prescribed potential difference (Vback2) is secured.

As comparative example 1 and comparative example 2, image forming apparatuses that switch and apply any of first and second charging voltages to a charging roller 2 are used. The image forming apparatus of the comparative example 1 applies a first developing voltage to a developing roller 41 but does not apply a second developing voltage to the developing roller 41 when a paper passing region and a paper non-passing region face the developing roller 41. The image forming apparatus of the comparative example 2 applies a second developing voltage to a developing roller 41 but does not apply a first developing voltage to the developing roller 41 when a paper passing region and a paper non-passing region face the developing roller 41.

Experiment 1

As the experimental method of experiment 1, two A4 recording papers P are sequentially fed, and a fogging amount of the paper passing region and a fogging amount of the paper non-passing region are measured. A method for measuring the fogging amounts of the paper passing region and the paper non-passing region is the same as the method for measuring a fogging amount on the photosensitive drum 1. Table 1 shows the results of the experiment 1. In table 1, a difference between a first whiteness degree (%) and a second whiteness degree (%) is shown as a fogging amount. Further, the fogging amount of the paper passing region may be the ratio of the area of toner in the paper passing region to the area of the paper passing region. The fogging amount of the paper non-passing region may be the ratio of the area of toner in the paper non-passing region to the area of the paper non-passing region. The lower the fogging amount of the paper passing region, the better the quality of an image is. Specifically, the fogging amount of the paper passing region is preferably not more than 3%. In the first embodiment, respective potentials are set so that the fogging amount of the paper passing region becomes not more than 3%.

TABLE 1

| | Fogging amount of paper passing region | Fogging amount of paper non-passing region |
|---|---|---|
| First Embodiment | 0.5% | 0.5% |
| Comparative Example 1 | 0.5% | 10% |
| Comparative Example 2 | 3.1% | 0.5% |

In the comparative example 1, the fogging amount of the paper non-passing region is large since a potential difference (Vback) between the surface potential (Vd2) of the paper non-passing region and the developing potential (Vdc1) of the developing roller 41 is not properly secured. In the comparative example 2, the fogging amount of the paper passing region is large since a potential difference (Vback) between the surface potential (Vd1) of the paper passing region and the developing potential (Vdc2) of the developing roller 41 is not properly secured. On the other hand, it is possible to reduce the fogging amounts of the paper passing region and the paper non-passing region in the first embodiment since the potential differences (Vback1 and Vback2) are properly securable.

The above description shows an example in which an AC voltage is applied to the developing roller 41 as a developing voltage. However, a DC voltage may be applied to the developing roller 41 as a developing voltage. For example, when the developing roller 41 is arranged so as to be in contact with the photosensitive drum 1 (contact development method), a DC voltage is applied to the developing roller 41. A DC voltage of −320 V may be applied as a first developing voltage from the developing high-voltage power supply 304 to the developing roller 41. Thus, a developing potential (Vdc1) of −320 V is formed in the developing roller 41 when the paper passing region faces the developing roller 41. A DC voltage of −270 V may be applied as a second developing voltage from the developing high-voltage power supply 304 to the developing roller 41. Thus, a developing potential (Vdc2) of −270 V is formed in the developing roller 41 when the paper non-passing region faces the developing roller 41. In this case, the DC voltage applied as a second developing voltage has the same polarity as that of the DC voltage applied as a first developing voltage. Further, the absolute value of the first developing voltage is larger than that of the second developing voltage. Further, a developing voltage obtained by superimposing an AC voltage on a DC voltage may be applied to the developing roller 41.

Second Embodiment

An image forming apparatus 100 according to a second embodiment will be described. Note that since configurations other than configurations described below are similar to those of the first embodiment, their detailed descriptions will be omitted.

In the second embodiment, a state in which a recording paper P exists at a transfer nip portion Nt will be called a paper passing state. The surface region of a photosensitive drum 1 has at least a first region, a second region, and a third region. The first region and the third region of the surface region of the photosensitive drum 1 come into contact with the recording paper P at the transfer nip portion Nt. In the second embodiment, a region including the first region and the third region of the photosensitive drum 1 will be called a paper passing region, the first region of the photosensitive drum 1 will be called a first paper passing region, and the third region of the photosensitive drum 1 will be called a second paper passing region. In the second embodiment, a state in which the recording paper P before reaching the transfer nip portion Nt does not exist at the transfer nip portion Nt will be called a paper non-passing state. The second region of the surface region of the photosensitive drum 1 does not come into contact with the recording paper P at the transfer nip portion Nt. In the second embodiment, the second region of the photosensitive drum 1 will be called a paper non-passing region. The paper non-passing region is positioned downstream of the paper passing region in the rotating direction of the photosensitive drum 1. The second paper passing region is positioned between the first paper passing region and the paper non-passing region. Accordingly, the first paper passing region is separated from the paper non-passing region, and the second paper passing region is continuous with the first paper passing region and the paper non-passing region. The second paper passing region is the region of the photosensitive drum 1 that is positioned between the first paper passing region and the paper non-passing region and does not come into contact with the recording paper P at the transfer nip portion Nt in a state in which a transfer voltage is applied to a transfer roller 5 and the recording paper P is held by the transfer nip portion Nt.

The image forming apparatus 100 of the second embodiment switches between a first charging voltage for forming a surface potential (Vd1) of the first paper passing region and a second charging voltage for forming a surface potential (Vd2) of the paper non-passing region. The image forming apparatus 100 applies a second developing voltage to a developing roller 41 when the paper non-passing region in which a surface potential has been formed faces the developing roller 41, and then applies a first developing voltage to the developing roller 41 when the paper passing region in which a surface potential has been formed faces the developing roller 41. In addition, the second embodiment is characterized in that a charging voltage with consideration given to an overshoot occurring during the switching of a developing voltage is used. Specifically, the second embodiment is characterized in that a third charging voltage for securing a developing potential overshooting at the switching timing of a developing voltage and a potential difference (Vback3) serving as a third potential difference that does not cause fogging is used.

When a first charging voltage is applied to the charging roller 2 and the first paper passing region is charged by the charging roller 2, a surface potential (first surface potential) is formed in the first paper passing region. When a second charging voltage is applied to the charging roller 2 and the paper non-passing region is charged by the charging roller 2, a surface potential (second surface potential) is formed in the paper non-passing region. When a third charging voltage is applied to the charging roller 2 and the second paper passing region is charged by the charging roller 2, a surface potential (third surface potential) is formed in the second paper passing region. The paper non-passing region is positioned downstream of the paper passing region in the rotating direction of the photosensitive drum 1, and the second paper passing region is positioned between the first paper passing region and the paper non-passing region. Therefore, a surface potential is first formed in the paper non-passing region, and then a surface potential is formed in the second paper passing region. After that, a surface potential is formed in the first paper passing region. The absolute value of the surface potential of the first paper passing region is larger than that of the surface potential of the paper non-passing region. The absolute value of the surface potential of the second paper passing region is larger than those of the surface potentials of the first paper passing region and the paper non-passing region.

When a second developing voltage is switched to a first developing voltage at the timing at which the tip end of the paper passing region reaches a position facing the developing roller 41 like the first embodiment, a developing potential may overshoot before turning into a desired potential. An overshooting developing potential (Vdc3) becomes larger than a target developing potential (for example, Vdc1). In this case, a potential difference (Vback) between the surface potential (Vd1) of the paper passing region and the developing potential (Vdc3) becomes smaller than expected. Therefore, band-shaped toner is formed on the photosensitive drum 1 in some cases, and an image failure may occur. Note that although a charging potential overshoots during the switching of a charging voltage, the overshoot of the charging potential does not exert a large influence upon the surface potential of the photosensitive drum 1 due to the volume resistance of the charging roller 2.

Figure 7:
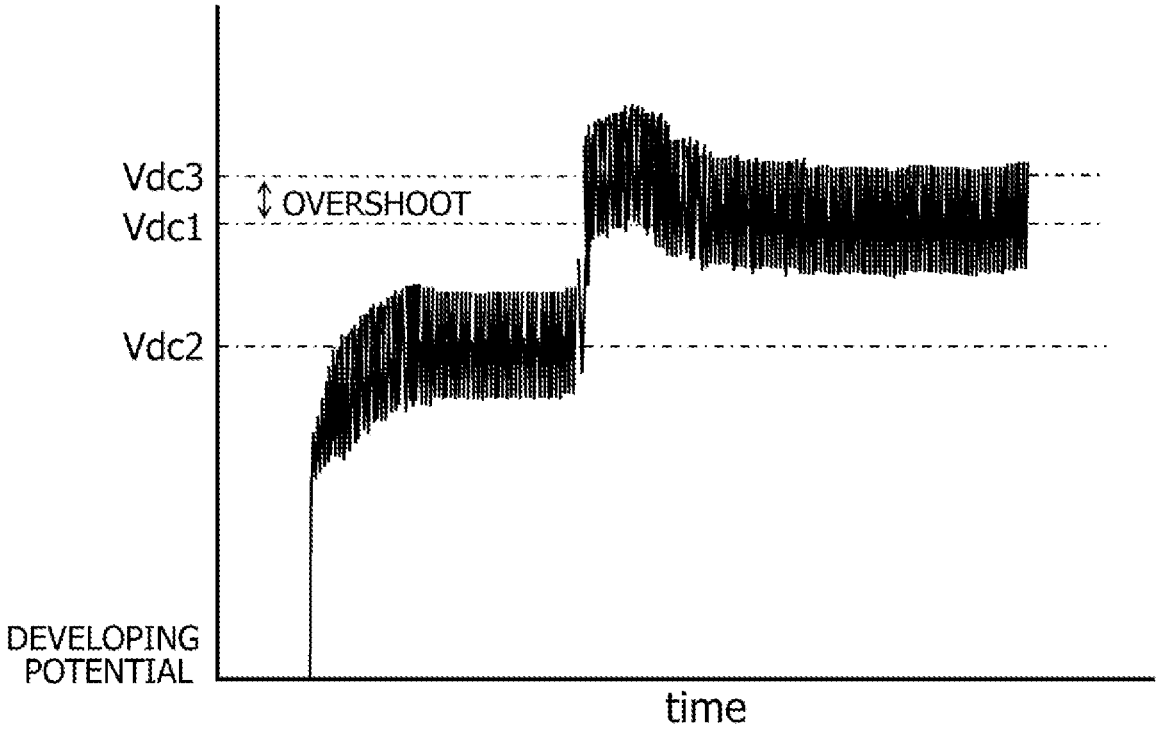
FIG. 7 is a diagram showing waveforms formed when developing potentials rise.

FIG. 7 shows waveforms formed when developing potentials rise. At the moment at which a second developing voltage is switched to a first developing voltage, a developing potential (Vdc1) overshoots and increases by about 30 V in the second embodiment. In this case, the second paper passing region in which a surface potential has been formed faces the developing roller 41. The developing potential (Vdc1) overshoots when the second paper passing region in which the surface potential has been formed faces the developing roller 41 and when the second developing voltage is switched to the first developing voltage. As a result, a developing potential (Vdc3) is formed in the developing roller 41. The developing potential (Vdc3) is an example of a third developing potential. The absolute value of the developing potential (Vdc3) is larger than those of the developing potentials (Vdc1) and (Vdc2). Note that the overshooting developing potential (Vdc3) gradually decreases and converges into the target developing potential (Vdc2) after a prescribed time (for example, after 50 milliseconds).

When the developing potential (Vdc1) overshoots, a potential difference (Vback1) between the surface potential (Vd1) and the developing potential (Vdc1) instantaneously decreases down to 50 V. As in the first embodiment, when the second developing voltage is switched to the first developing voltage so that the potential difference (Vback1) becomes 80 V, the band of fogging occurs on an image since the potential difference (Vback1) instantaneously decreases. The relationship between the potential difference (Vback) between the surface potential (Vd) of the photosensitive drum 1 and the developing potential (Vdc) of the developing roller 41 and a fogging amount on the photosensitive drum 1 in the second embodiment is also shown in FIG. 5. Accordingly, like the first embodiment, the range of the potential difference (Vback1) for obtaining an excellent-quality image with a fogging amount of not more than 2% becomes at least 105 V and not more than 120 V when the overshoot of the developing potential (Vdc1) is considered in the second embodiment. As described above, when an overshoot occurs, the range of the potential difference (Vback1) where the overshoot does not occur narrows. On the other hand, a charging voltage is increased in advance at the timing at which the developing potential (Vdc1) overshoots in the second embodiment, whereby it is possible to reduce the band of fogging on an image.

Figure 8:
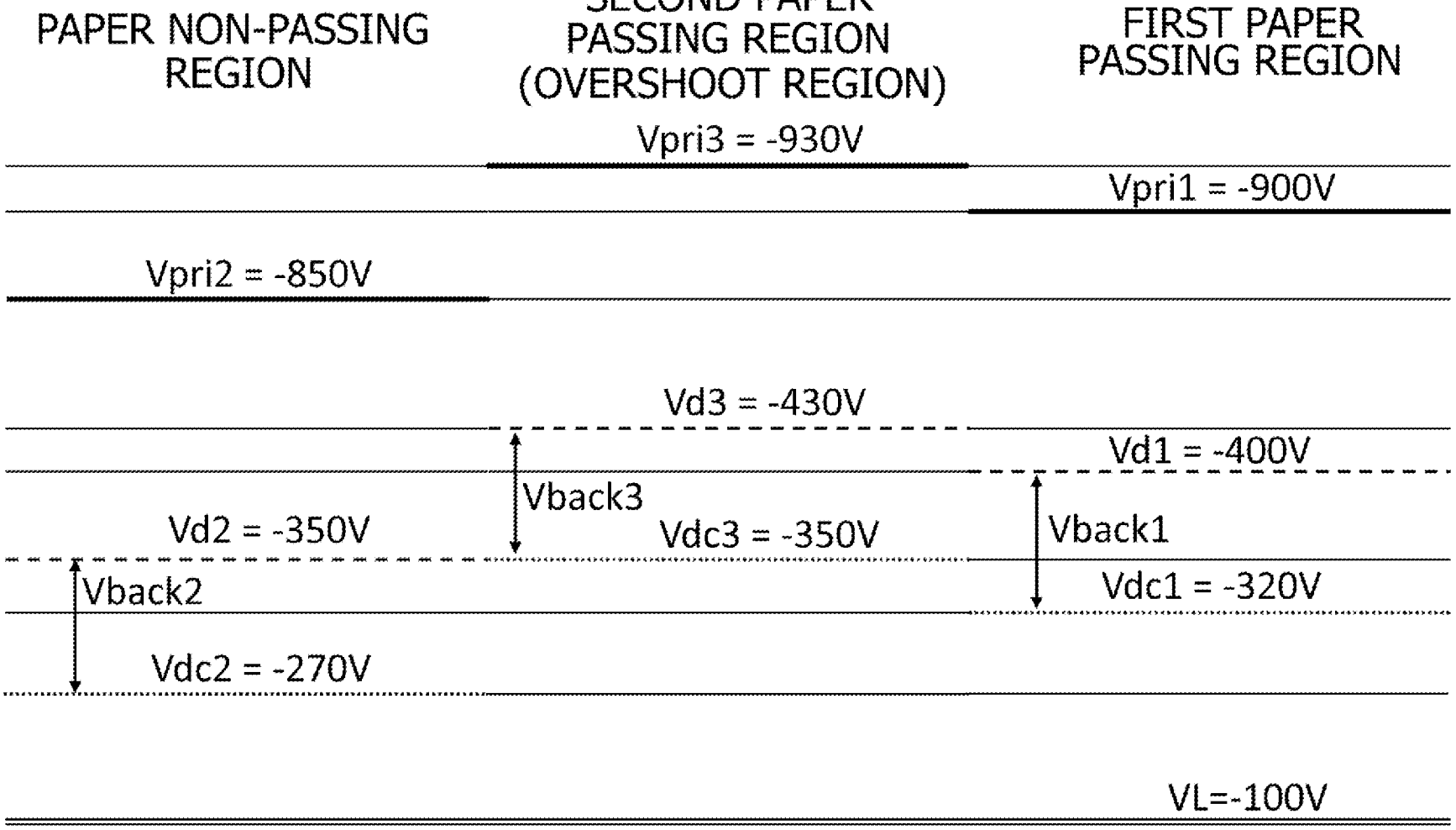
FIG. 8 is a diagram showing the relationship between respective potentials according to a second embodiment.

The relationship between the potentials of respective members in the second embodiment will be described using FIG. 8. At the timing at which a second charging voltage is switched to a first charging voltage, a third charging voltage with consideration given to an overshoot is applied to the charging roller 2 for 50 milliseconds. Like this, the third charging voltage is applied to the charging roller 2 according to the timing at which a developing potential (Vdc1) overshoots. When the developing potential (Vdc1) overshoots and increases by 30 V, a third charging voltage is applied to the charging roller 2 so that a charging potential (Vpri3) of the charging roller 2 becomes −930 V. For example, a DC voltage of −930 V is applied as a third charging voltage from a charging high-voltage power supply 303 to the charging roller 2. The charging potential (Vpri3) is an example of a third charging potential. The absolute value of the charging potential (Vpri3) is larger than those of charging potentials (Vpri1) and (Vpri2). The absolute value of the third charging voltage is larger than those of the first and second charging voltages.

A charging potential (Vpri3) of −930 V is higher than a charging potential (Vpri2) of −900 V by 30 V toward a negative side. Thus, the surface potential (Vd3) of the photosensitive drum 1 at the timing at which an overshoot occurs becomes −430 V. A developing potential (Vdc3) at which an overshoot occurs is −350 V. Accordingly, a potential difference (Vback3) between the surface potential (Vd3) of the photosensitive drum 1 and the developing potential (Vdc3) of the developing roller 41 at the timing at which an overshoot occurs becomes 80 V. Thus, it is possible to reduce the band of fogging on an image. The surface potentials (Vd1, Vd2, and Vd3), the charging potentials (Vpri1, Vpri2, and Vpri3), and the developing potentials (Vdc1, Vdc2, and Vdc3) have the same polarity. The first, second, and third charging voltages and the first and second developing voltages have the same polarity. The polarity of each of the surface potentials (Vd1, Vd2, and Vd3) and the first and second developing voltages may be a normal polarity. In addition, the polarity of each of respective potentials and respective voltages may be a normal polarity.

Like the first embodiment, it is possible to obtain an excellent-quality image when a potential difference (Vback)

is at least 75 V and not more than 120 V in the second embodiment. Accordingly, respective potentials are preferably set so that a potential difference (Vback3) becomes at least 75 V and not more than 120 V. Note that the second embodiment describes a case in which a developing potential (Vdc1) overshoots and increases by about 30 V but an increase in the developing potential (Vdc1) is not limited to 30 V. An overshoot amount is different in some cases depending on the performance or the configuration of a developing high-voltage power supply 304, or varies in some cases depending on a switching amount (|Vdc1−Vdc2|) of a developing potential. A charging potential (Vpri3) with consideration given to an overshoot may be set depending on the performance or the configuration of the developing high-voltage power supply 304 and depending on a switching amount of a developing potential. The control device 300 may control the charging high-voltage power supply 303 and the developing high-voltage power supply 304 so that a potential difference (Vback3), at which the ratio of the area of toner in the second paper passing region to the area of the second paper passing region becomes not more than 2%, is formed. The control device 300 may control the charging high-voltage power supply 303 and the developing high-voltage power supply 304 so that a potential difference (Vback3), at which the ratio of the area of toner in the second paper passing region to the area of the second paper passing region falls within a range in which the quality of an image is allowable, is formed.

Figure 9:
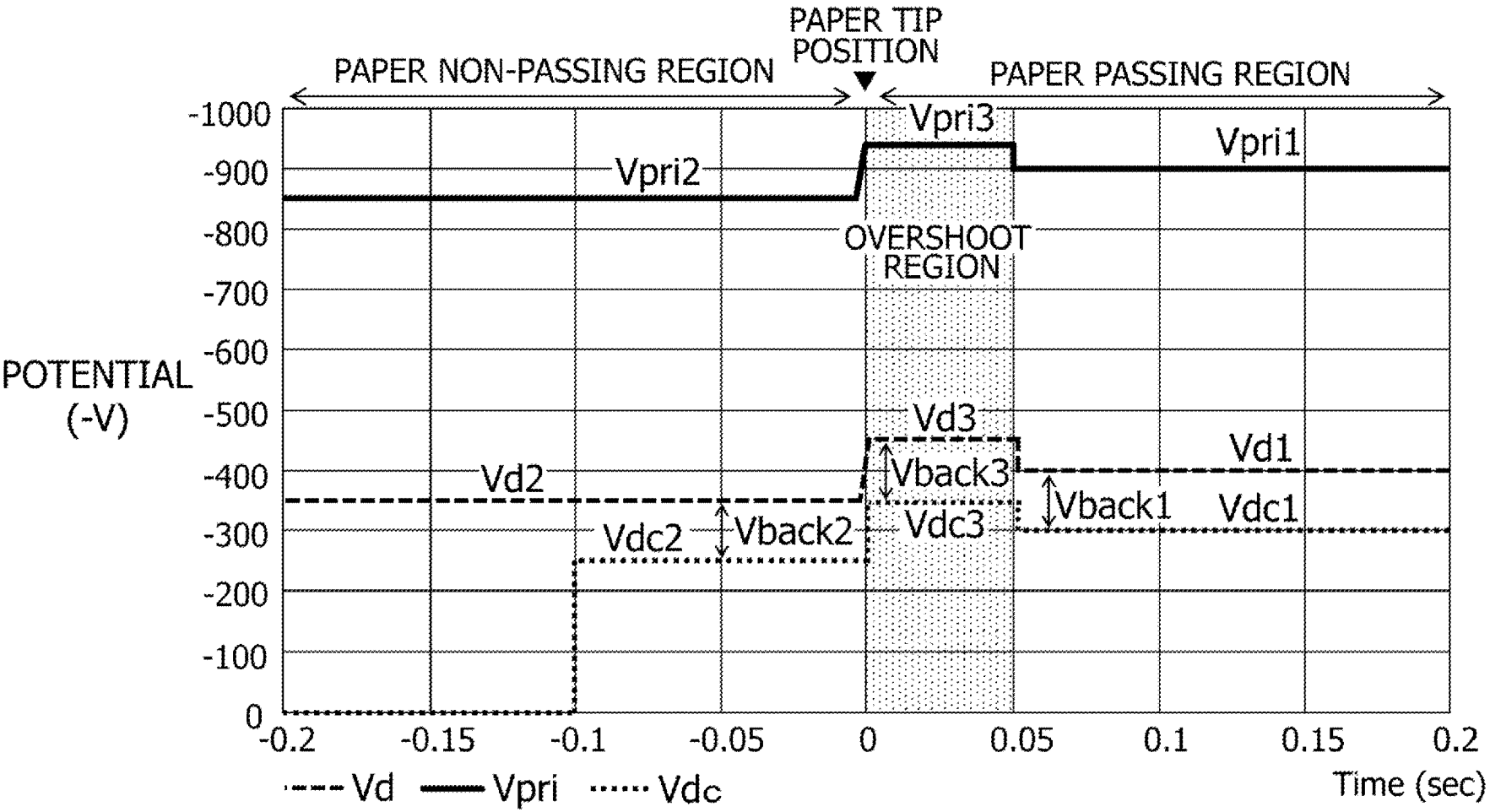
FIG. 9 is a diagram showing the output waveforms of the respective potentials according to the second embodiment.

FIG. 9 shows the waveforms of respective potentials in the second embodiment. In FIG. 9, a Y-axis (vertical axis) shows a potential. In FIG. 9, the waveforms of the respective potentials before and after the tip end of the recording paper P enters the transfer nip portion Nt are shown. The timings at which the respective potentials are output are shown with their phases matching to the surface of the photosensitive drum 1. A coordinate 0 in an X-axis shows the timing at which the tip end of the recording paper P enters the transfer nip portion Nt. A charging potential (Vpri2) is formed in the charging roller 2 when a second charging voltage is applied to the charging roller 2, and a surface potential (Vd2) is formed in the paper non-passing region. That is, the second charging voltage is applied to the charging roller 2 so that the surface potential (Vd2) is formed in the surface region (paper non-passing region) of the photosensitive drum 1 at the transfer nip portion Nt when the recording paper P does not exist at the transfer nip portion Nt.

A developing voltage is turned on 100 milliseconds before the recording paper P enters the transfer nip portion Nt. At this time, a developing potential (Vdc2) is formed in the developing roller 41 when a second developing voltage is applied to the developing roller 41. Accordingly, a potential difference (Vback2=|Vd2−Vdc2|) between the surface potential (Vd2) of the paper non-passing region when the paper non-passing region faces the developing roller 41 and the developing potential (Vdc2) when the paper non-passing region faces the developing roller 41 becomes 80 V. Thus, the fogging of the paper non-passing region is reduced. Note that time in the X-axis (horizontal axis) of FIG. 9 shows the timing at which the second developing voltage is applied to the developing roller 41 and does not show the timing at which the second developing voltage is switched to the first developing voltage.

The control device 300 switches the second developing voltage to the first developing voltage at the timing at which the tip end of the paper passing region faces the developing roller 41. At this time, a developing potential (Vdc1) overshoots. That is, the developing potential (Vdc1) overshoots to a developing potential (Vdc3) higher than the developing potential (Vdc2) at the timing at which the second developing voltage is switched to the first developing voltage, and then converges into the developing potential (Vdc2). In view of this, a third charging voltage with consideration given to the occurrence of an overshoot is applied to the charging roller 2 at the timing at which the tip end of the paper passing region faces the developing roller 41. Thus, a surface potential (Vd3) is formed in the second paper passing region (overshoot region) at the timing at which a developing potential (Vdc) overshoots. Accordingly, a potential difference (Vback3=|Vd3−Vdc3|) between the surface potential (Vd3) of the second paper passing region and the developing potential (Vdc3) of the developing roller 41 becomes 80 V at the timing at which the developing potential (Vdc) overshoots. In other words, a potential difference between the surface potential (Vd3) of the second paper passing region when the second paper passing region faces the developing roller 41 and the developing potential (Vdc3) when the second paper passing region faces the developing roller 41 becomes 80 V. Therefore, the fogging of the second paper passing region is reduced, and the band of fogging on an image is reduced. As a result, it is possible to reduce a toner consumption amount.

After that, the control device 300 switches the third charging voltage to a first charging voltage since the overshoot of the developing potential (Vdc1) converges. For example, the control device 300 switches the third charging voltage to the first charging voltage 50 milliseconds after the timing at which the tip end of the paper passing region on the downstream side of the photosensitive drum 1 faces the charging roller 2. The timing at which the control device 300 switches the third charging voltage to the first charging voltage may be arbitrary timing. When the first charging voltage is applied to the charging roller 2, a charging potential (Vpri1) is formed in the charging roller 2 and a surface potential (Vd1) is formed in the first paper passing region. Accordingly, a potential difference (Vback1=|Vd1−Vdc1|) between the surface potential (Vd1) of the first paper passing region when the first paper passing region faces the developing roller 41 and the developing potential (Vdc1) when the first paper passing region faces the developing roller 41 becomes 80 V. Therefore, the fogging of the first paper passing region is reduced. As a result, it is possible to reduce a toner consumption amount.

According to the second embodiment, it is possible to retain a potential difference (Vback) at the timing at which an overshoot occurs at a value at which fogging does not occur even if the overshoot occurs when a developing potential (Vdc) is switched. Therefore, it is possible to reduce the band of fogging on an image due to the overshoot of a developing potential (Vdc).

In the above description, a potential difference between a charging potential (Vpri1) and a charging potential (Vpri3) and a potential difference between a developing potential (Vdc1) and a developing potential (Vdc3) are the same. However, the potential difference between the charging potential (Vpri1) and the charging potential (Vpri3) may be larger than the potential difference between the developing potential (Vdc1) and the developing potential (Vdc3) so long as fogging does not occur. That is, the potential difference between the charging potential (Vpri1) and the charging potential (Vpri3) may be at least the potential difference between the developing potential (Vdc1) and the developing potential (Vdc3). Further, the potential difference between the charging potential (Vpri1) and the charging potential (Vpri3) may be smaller than the potential difference between the developing potential (Vdc1) and the developing potential (Vdc3) so long as fogging does not occur. That is, the potential difference between the charging potential (Vpri1) and the charging potential (Vpri3) may be not more than the potential difference between the developing potential (Vdc1) and the developing potential (Vdc3).

In the first and second embodiments, a potential difference between a charging potential (Vpri1) and a charging potential (Vpri2) is set at 50 V. However, the potential difference between the charging potential (Vpri1) and the charging potential (Vpri2) may be set at a value other than 50 V when it is possible to reduce a memory. Accordingly, a difference between a first charging voltage and a second charging voltage may be set at a value other than 50 V when it is possible to reduce a memory.

In the first and second embodiments, a potential difference (50 V) between a charging potential (Vpri1) and a charging potential (Vpri2) is the same as a potential difference (50 V) between a developing potential (Vdc1) and a developing potential (Vdc2). When it is possible to reduce the fogging of the paper passing region and the paper non-passing region, the potential difference between the charging potential (Vpri1) and the charging potential (Vpri2) may be different from the potential difference between the developing potential (Vdc1) and the developing potential (Vdc2). For example, the potential difference between the charging potential (Vpri1) and the charging potential (Vpri2) may be larger than the potential difference between the developing potential (Vdc1) and the developing potential (Vdc2). For example, the potential difference between the charging potential (Vpri1) and the charging potential (Vpri2) may be smaller than the potential difference between the developing potential (Vdc1) and the developing potential (Vdc2).

When it is possible to reduce the fogging of the paper passing region and the paper non-passing region to such an extent that does not cause a practical problem, potential differences (Vback1) and (Vback2) may be set at values other than 80 V. For example, the potential differences (Vback1) and (Vback2) may be set so as to fall within a prescribed range. In this case, the control device 300 controls the charging high-voltage power supply 303 and the developing high-voltage power supply 304 so that the potential differences (Vback1) and (Vback2) fall within the prescribed range. The prescribed range is, for example, at least 75 V and not more than 120 V. The potential difference (Vback1) may be the same as or different from the potential difference (Vback2). When the potential differences (Vback1) and (Vback2) are at least 75 V and not more than 120 V, it is possible to reduce fogging amounts of the paper passing region and the paper non-passing region to not more than 2%. Accordingly, the control device 300 controls the potential difference (Vback1) and the potential difference (Vback2) so that fogging amounts of the paper passing region and the paper non-passing region become not more than 2% (prescribed value). As a result, the fogging of the paper passing region and the paper non-passing region is reduced to such an extent that does not cause a practical problem.

When it is possible to reduce the fogging of the second paper passing region to such an extent that does not cause a practical problem, a potential difference (Vback3) may be set at a value other than 80 V. For example, the potential difference (Vback3) may be set so as to fall within a prescribed range. In this case, the control device 300 controls the charging high-voltage power supply 303 and the developing high-voltage power supply 304 so that the potential difference (Vback3) falls within the prescribed range. The prescribed range is, for example, at least 75 V and not more than 120 V. The potential difference (Vback3) may be the same as the potential differences (Vback1) and (Vback2), may be different from the potential difference (Vback1), or may be different from the potential difference (Vback2). When the potential difference (Vback3) is at least 75 V and not more than 120 V, it is possible to reduce a fogging amount of the second paper passing region to not more than 2%. Accordingly, the control device 300 controls the potential difference (Vback3) so that a fogging amount of the second paper passing region becomes not more than 2% (prescribed value). As a result, the fogging of the second paper passing region is reduced to such an extent that does not cause a practical problem. The fogging amount of the second paper passing region may be the ratio of the area of toner in the second paper passing region to the area of the second paper passing region.

The number of switching times, a switching method, and switching timing for switching a charging voltage or a developing voltage may be arbitrarily set depending on the configuration of the image forming apparatus 100. A roller charging system using a conductive roller (charging roller 2) is used in the first and second embodiments, but another charging system, for example, a corona charging system may be used. Even with another charging system, a similar effect is obtained. The image forming apparatus 100 is configured to include the cleaning apparatus 7 in the first and second embodiments, but a similar effect is obtained even with an image forming apparatus 100 of a cleaner-less system.

It is possible to reduce a memory occurring at a transfer nip and reduce fogging. While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2020-095756, filed on Jun. 1, 2020, which is hereby incorporated by reference herein in its entirety.

What is claimed is:

1. An image forming apparatus comprising:

photosensitive drum that is rotatable;

a charging roller that comes into contact with the photosensitive drum to form a charging portion and that charges a surface of the photosensitive drum at the charging portion;

an exposure unit that exposes the photosensitive drum to form an electrostatic latent image on the surface of the photosensitive drum;

a developing roller that bears a developer charged to have a normal polarity and supplies the developer to the electrostatic latent image formed on the surface of the photosensitive drum to form a developer image on the surface of the photosensitive drum;

a transfer roller that comes into contact with the photosensitive drum to form a nip and transfers the developer image onto a recording material conveyed to the nip;

a charging voltage application portion that applies a charging voltage of the normal polarity to the charging roller;

a developing voltage application portion that applies a developing voltage to the developing roller;

a transfer voltage application portion that applies a transfer voltage to the transfer roller; and a controller that controls the charging voltage application portion, the developing voltage application portion, and the transfer voltage application portion, wherein, when a region of the photosensitive drum that comes into contact with the recording material at the nip in a state in which the transfer voltage is applied to the transfer roller and the recording material is held by the nip is assumed as a first region, a region of the photosensitive drum that comes into contact with the transfer roller in a state in which the transfer voltage is applied to the transfer roller and the recording material is not held by the nip is assumed as a second region, a region of the photosensitive drum after the first region passes through the nip and before the second region passes through the nip is assumed as a third region, and the third region comes into contact with the recording material at the nip in a state in which the transfer voltage is applied to the transfer roller and the recording material is held by the nip, the controller controls to apply a first developing voltage to the developing roller when the first region in which a first surface potential has been formed at the charging portion to which a first charging voltage has been applied faces the developing roller and apply a second developing voltage lower than an absolute value of the first developing voltage to the developing roller when the second region in which a second surface potential has been formed at the charging portion to which a second charging voltage has been applied faces the developing roller after the recording material passes through the nip, the second charging voltage has a polarity that is the same as a polarity of the first charging voltage and is lower than an absolute value of the first charging voltage, the controller controls to apply a third charging voltage to the third region in which a third surface potential has been formed at the charging portion, and the third charging voltage has a polarity that is the same as a polarity of the second charging voltage and is higher than an absolute value of the second charging voltage.

2. The image forming apparatus according to claim 1, wherein each of the first surface potential, the second surface potential, the first developing voltage, and the second developing voltage has the normal polarity.

3. The image forming apparatus according to claim 1, wherein an absolute value of the first surface potential is higher than an absolute value of the second surface potential.

4. The image forming apparatus according to claim 1, wherein a first charging potential that is used to form the first surface potential is formed in the charging roller, a second charging potential that has a polarity that is the same as a polarity of the first charging potential and is used to form the second surface potential is formed in the charging roller, and an absolute value of the first charging potential is higher than an absolute value of the second charging potential.

5. The image forming apparatus according to claim 4, wherein the first charging potential is formed when the charging voltage application portion applies a first charging voltage to the charging roller, the second charging potential is formed when the charging voltage application portion applies a second charging voltage having a polarity that is the same as a polarity of the first charging voltage to the charging roller, and the absolute value of the first charging voltage is higher than the absolute value of the second charging voltage.

6. The image forming apparatus according to claim 1, wherein, developing roller overshoots when the third region in which the third surface potential has been formed at the charging portion faces the developing roller and when the second developing voltage is switched to the first developing voltage, and an absolute value of the developing potential due to an overshoot of the developing potential is higher than an absolute value of the developing potential formed when the first developing voltage is applied to the developing roller.

7. The image forming apparatus according to claim 6, wherein an absolute value of the third surface potential is higher than each of an absolute value of the first surface potential and an absolute value of the second surface potential.

8. The image forming apparatus according to claim 6, wherein a first developing potential is formed in the developing roller when the first developing voltage is applied to the developing roller, a second developing potential is formed in the developing roller when the second developing voltage is applied to the developing roller, a third developing potential is formed in the developing roller when the first developing potential overshoots, and the controller controls the charging voltage application portion and the developing voltage application portion so that a third potential difference, at which a ratio of an area of the developer in the third region to an area of the third region becomes not more than 2%, is formed as to the third potential difference between the third surface potential and the third developing potential.

9. The image forming apparatus according to claim 6, wherein a first developing potential is formed in the developing roller when the first developing voltage is applied to the developing roller, a second developing potential is formed in the developing roller when the second developing voltage is applied to the developing roller, a third developing potential is formed in the developing roller when the first developing potential overshoots, and the controller controls the charging voltage application portion and the developing voltage application portion so that a third potential difference, at which a ratio of an area of the developer in the third region to an area of the third region falls within a range in which quality of an image is allowed, is formed as to the third potential difference between the third surface potential and the third developing potential.

10. The image forming apparatus according to claim 1, wherein a first developing potential is formed in the developing roller when the first developing voltage is applied to the developing roller, a second developing potential is formed in the developing roller when the second developing voltage is applied to the developing roller, and the controller controls the charging voltage application portion and the developing voltage application portion so that a first potential difference, at which a ratio of an area of the developer in the first region to an area of the first region becomes not more than 2%, is formed as to the first potential difference between the first surface potential and the first developing potential.

11. The image forming apparatus according to claim 1, wherein a first developing potential is formed in the developing roller when the first developing voltage is applied to the developing roller, a second developing potential is formed in the developing roller when the second developing voltage is applied to the developing roller, and the controller controls the charging voltage application portion and the developing voltage application portion so that a first potential difference, at which a ratio of an area of the developer in the first region to an area of the first region falls within a range in which quality of an image is allowed, is formed as to the first potential difference between the first surface potential and the first developing potential.

12. The image forming apparatus according to claim 1, wherein a second developing potential is formed in the developing roller when the second developing voltage is applied to the developing roller, and the controller controls the charging voltage application portion and the developing voltage application portion so that a second potential difference, at which a ratio of an area of the developer in the second region to an area of the second region becomes not more than 2%, is formed as to the second potential difference between the second surface potential and the second developing potential.

13. The image forming apparatus according to claim 1, wherein a second developing potential is formed in the developing roller when the second developing voltage is applied to the developing roller, and the controller controls the charging voltage application portion and the developing voltage application portion so that a second potential difference, at which a ratio of an area of the developer in the second region to an area of the second region falls within a range in which quality of an image is allowed, is formed as to the second potential difference between the second surface potential and the second developing potential.

14. The image forming apparatus according to claim 1, wherein the developing roller is arranged so as not to be in contact with the photosensitive drum, and the first developing voltage and the second developing voltage are AC voltages.

15. The image forming apparatus according to claim 1, wherein the developing roller is arranged so as to be in contact with the photosensitive drum, the first developing voltage and the second developing voltage are DC voltages having a same polarity, and the absolute value of the first developing voltage is higher than an absolute value of the second developing voltage.

16. The image forming apparatus according to claim 1, wherein the second developing voltage is applied within a prescribed time after a timing at which a tip end of the second region on a downstream side in a rotating direction of the photosensitive drum reaches a position facing the developing roller.

17. An image forming apparatus comprising:

a photosensitive drum that is rotatable;

a charging roller that comes into contact with the photosensitive drum to form a charging portion and that charges a surface of the photosensitive drum at the charging portion;

an exposure unit that exposes the photosensitive drum to form an electrostatic latent image on the surface of the photosensitive drum;

a developing roller that bears a developer charged to have a normal polarity and supplies the developer to the electrostatic latent image formed on the surface of the photosensitive drum to form a developer image on the surface of the photosensitive drum;

a transfer roller that comes into contact with the photosensitive drum to form a nip and transfers the developer image onto a recording material conveyed to the nip;

a charging voltage application portion that applies a charging voltage of the normal polarity to the charging roller;

a developing voltage application portion that applies a developing voltage to the developing roller;

a transfer voltage application portion that applies a transfer voltage to the transfer roller; and a controller that controls the charging voltage application portion, the developing voltage application portion, and the transfer voltage application portion, wherein, when a region of the photosensitive drum that comes into contact with the recording material at the nip in a state in which the transfer voltage is applied to the transfer roller and the recording material is held by the nip is assumed as a first region, a region of the photosensitive drum that comes into contact with the transfer roller in a state in which the transfer voltage is applied to the transfer roller and the recording material is not held by the nip is assumed as a second region, a region of the photosensitive drum after the first region passes through the nip and before the second region passes through the nip is assumed as a third region, the third region comes into contact with the recording material at the nip in a state in which the transfer voltage is applied to the transfer roller and the recording material is held by the nip, and a potential difference between a surface potential formed on the photosensitive drum and the developing voltage at a developing portion is assumed as a back contrast, the controller controls to apply a first developing voltage to the developing roller when the first region in which a first surface potential has been formed at the charging portion faces the developing roller and apply a second developing voltage lower than an absolute value of the first developing voltage to the developing roller when the second region in which a second surface potential has been formed at the charging portion faces the developing roller after the recording material passes through the nip, a second back contrast in a case where the developing portion is formed by the second region is greater than a first back contrast in a case where the developing portion is formed by the first region, and the first back contrast is greater than a third back contrast in a case where the developing portion is formed by the third region in which a third surface potential has been formed at the charging portion.

18. The image forming apparatus according to claim 17, wherein each of the first surface potential, the second surface potential, the third surface potential, the first developing voltage, and the second developing voltage has the normal polarity.

19. The image forming apparatus according to claim 17, wherein an absolute value of the first surface potential is higher than an absolute value of the second surface potential, and an absolute value of the third surface potential is higher than the absolute value of the first surface potential.

* * * * *